US008091878B2

(12) United States Patent
Honegger

(10) Patent No.: US 8,091,878 B2
(45) Date of Patent: Jan. 10, 2012

(54) CONVEYING APPARATUS

(75) Inventor: Werner Honegger, Bach (CH)

(73) Assignee: Ferag AG, Hinwil (CH)

( * ) Notice: Subject to any disclaimer, the term of this patent is extended or adjusted under 35 U.S.C. 154(b) by 248 days.

(21) Appl. No.: 12/515,153

(22) PCT Filed: Jul. 30, 2007

(86) PCT No.: PCT/CH2007/000373

§ 371 (c)(1),
(2), (4) Date: Jun. 29, 2009

(87) PCT Pub. No.: WO2008/058405

PCT Pub. Date: May 22, 2008

(65) Prior Publication Data

US 2010/0052235 A1 Mar. 4, 2010

(30) Foreign Application Priority Data

Nov. 17, 2006 (CH) ..... 1856/06

(51) Int. Cl.
*B65H 39/00* (2006.01)

(52) U.S. Cl. ..... 270/52.16; 270/58.29; 198/474.1

(58) Field of Classification Search ..... 270/52.14, 270/52.16, 52.26, 52.19, 58.29; 198/474.1, 198/469.1, 867.11, 867.13, 803.14
See application file for complete search history.

(56) References Cited

U.S. PATENT DOCUMENTS

| | | | | |
|---|---|---|---|---|
| 3,221,902 | A | 12/1965 | Young | |
| 3,526,170 | A | 9/1970 | Oderman | |
| 4,124,203 | A | 11/1978 | Muller | |
| 5,737,987 | A | 4/1998 | Olson et al. | |
| 5,876,029 | A * | 3/1999 | Wright et al. | 271/3.18 |
| 2009/0020938 | A1 | 1/2009 | Honegger | |

FOREIGN PATENT DOCUMENTS

| | | |
|---|---|---|
| DE | 1217974 | 6/1966 |
| GB | 1020365 | 2/1966 |
| JP | 8108964 | 4/1996 |
| WO | 2007/085101 | 8/2007 |

* cited by examiner

*Primary Examiner* — Leslie A Nicholson, III
(74) *Attorney, Agent, or Firm* — Rankin, Hill & Clark LLP

(57) ABSTRACT

A conveying apparatus with conveying compartments (2) which can be displaced one behind the other along a conveying path has supporting surfaces (S) which are arranged in the conveying compartments and on which flat articles (G), in particular printed products, can be conveyed in a state in which they rest thereon. The supporting surfaces (S) are each formed by a flexible supporting belt (5). In order to set different angles between the supporting surface (S) and the conveying path (1), each conveying compartment (2) has a setting element (3), which acts on the supporting belt (5) in a region between two belt ends which are fastened at two fastening locations (10, 11) which are spaced apart from one another parallel to the conveying path (1). The setting element (3) is further equipped in order to press articles (G) against the supporting surface (S) in an adjacent conveying compartment (2').

33 Claims, 13 Drawing Sheets

IV
IV
B
A
C
S
G
1
2
2'
2"
3
3"
5
6
7
8
8.1
9
10
11
12
13
20
21
22
23
24
25
26
27

CONVEYING APPARATUS

BACKGROUND OF THE INVENTION

1. Field of the Invention

The invention lies in the field of conveyor technology and relates to a conveyor device according to the preamble of the independent patent claim. The conveyor device serves for conveying flat objects in conveyor compartments, in which in each case a flat object or in each case a plurality of flat objects stacked on one another, are conveyed lying on a support surface.

2. Description of Related Art

Conveyor methods, in which flat objects or stacks of such objects are conveyed in conveyor compartments lying on support surfaces are known, for example, in the field of further processing of printed products, in particular for the creation of printed product groups by way of collation. Thereby, the conveyor compartments are conveyed along a series of feed locations, and at each feed location, a printed product is fed essentially to each conveyor compartment, and deposited on the support surface of the conveyor compartment or on printed products which already lie or are stacked on this support surface, so that essentially the same stacks of printed products in all conveyor compartments are conveyed downstream of the last feed location. These stacks are then usually transferred to a following further conveyor device or to a processing device.

The Swiss patent application No. 0118/06 discloses a conveyor device, with which the conveyor method briefly described above may be carried out. This conveyor device comprises conveyor compartments which revolve on a closed path, for example on a conveyor member revolving along the path, and which are pivotable about an axis aligned transversely to the conveyor path, in a manner such that, for example, the spatial orientation of the support surfaces may be retained with a changing path course, or that the support surfaces may have different inclination angles relative to a horizontal, in different regions of the revolving path.

It is then the object of the invention, to create a further conveyor device with conveyor compartments, wherein the conveyor compartments comprise support surfaces, on which flat objects or stacks of flat objects may be conveyed in a lying manner. Thereby, an inclination angle of the support surfaces relative to the conveyor path should be able to be set in a controlled manner, and, as the case may be, it should also be possible to hold the objects on the conveyor surfaces during the conveying, such that a conveying is possible with alignments of the support surfaces, with which the gravitational force of the objects is not sufficient to hold these on the support surfaces. Despite this, the device should be able to be realised in a simple manner and be able to be controlled in a simple manner.

BRIEF SUMMARY OF THE INVENTION

This object is achieved by a conveyor device as is defined in the independent patent claim. The dependent patent claims define preferred embodiments of the conveyor device according to the invention.

The conveyor device according to the invention comprises a plurality of conveyor compartments which may be moved along an advantageously closed conveyor path. Each conveyor compartment comprises a support belt forming the support surface, and a setting element with whose help the support belt may be displaced relative to the conveyor path, and with this, an angle between the conveyor path and the support surface may be set. The support belt is longitudinally bendable, at least in one direction, and it extends between two fastening locations distanced to one another parallel to the conveyor path. Thereby, the setting element determines the course of the support belt between the two fastening means, and a tensioning means is provided, in order to keep the support belt tensioned between the fastening locations (free length), independently of its course and independently of the length of this course.

The support belts of the device, according to the invention, advantageously consist of a textile fabric or of a plastic foil and are advantageously bendable in a manner such that they may be wound in their length on a relatively thin roller. The tensioning means is advantageously a resiliently rotatable tensioning roller.

Advantageously, the setting element is arranged and designed between two adjacent conveyor compartments, in a manner such that, in addition to its function setting the support surface of a conveyor compartment, it may act on the adjacent conveyor compartment, and specifically in order to press objects conveyed in this conveyor compartment against the support surface and, thus, to hold them in the conveyor compartment, even if this support surface has a spatial alignment in which the gravity is not sufficient for such a retention.

The conveyor compartments are, for example, fastened essentially without a distance to one another on a revolving conveyor member (conveyor chain or conveyor belt), wherein the conveyor member is guided, for example, by way of deflection rollers (chain wheels or toothed wheels) and, as the case may be, by way of rails, on which running rollers arranged on the conveyor member roll, and wherein the conveyor path is defined by the course of the conveyor member. The conveyor compartments may however also be movable along rails more or less independently of one another, wherein the conveyor path is defined by the rails. In the latter case, the pressing function is only possible in conveyor path regions in which the conveyor compartments are conveyed with minimal distances to one another, thus for example conveyed in a manner abutting one another.

According to the preferred embodiment of the device according to the invention, the two fastening locations parallel to the conveyor path have a fixed distance to one another and perpendicular to the conveyor path have fixed distances to this. The two ends of the support belt are, thus for example, fastened on the conveyor member at two fixed locations which are distanced to one another. The setting element then acts on a region of the support belt between the fastening locations and deflects it more or less out of a straight-lined course between the fastening locations. In such a case, it is advantageous to combine the in each case first fastening location of the conveyor department with the in each case second fastening location of an adjacent conveyor compartment, and to also arrange the setting element and the tensioning means on this combined fastening location.

It is, however, also possible to arrange the first and second fastening locations along the conveyor member in a separate and alternating manner, and to attach the setting elements essentially between the conveyor compartments. Moreover, it is possible to only arrange the second fastening locations relative to the conveyor member in a stationary manner, to attach the setting elements at these fastening locations and to arrange the first fastening locations in a displaceable manner by way of the setting elements.

In the preferred embodiment (two fastening locations for the support belt which are stationary relative to the conveyor member), the setting element comprises a positioning roller which is directed transversely to the conveyor path, for example is aligned in a roughly horizontal manner, and which acts on that surface of the support belt, which lies opposite the support surface. Depending on the position of the positioning roller, the support belt extends directly between the two fastening locations, wherein the alignment of the support surface relative to the conveyor path is determined by these fastening locations, or it runs between the fastening locations over a positioning roller, wherein this then determines the alignment of the support surface relative to the conveyor path. Whilst the positioning roller is displaced from one position into another, it rolls on that surface of the support belt, which lies opposite the support surface. Thereby, the tensioning means compensates the length of the course of the belt, which changes as the case may be, and keeps the support belt tensioned. The tensioning means is, for example, a resiliently rotatable tension roller which is arranged in the region of the one fastening location and onto which the support belt is wound or from which it is unwound, depending on the change of its course.

For positioning the positioning roller, the setting element, for example, comprises a pivot lever, on whose distal end the positioning roller is mounted in a freely rotating manner. With a pivoting of the pivot lever, the positioning roller is moved along an essentially semicircular path, which lies on that side of the conveyor path, on which the conveyor compartments are arranged, and runs in a plane which is aligned parallel to the conveyor path.

The positioning roller of the preferred embodiment of the device according to the invention may assume infinitely many positions along the mentioned path. With regard to these positions, in particular the following three positions and the courses of the support belt which may be produced from these, are relevant for the function of the conveyor compartments:

A The support belt extends essentially in a straight line between the two fastening locations. The positioning roller is located between the two fastening locations and thereby has a distance to the conveyor path, which is roughly equally as large or smaller than the distance between the fastening locations and the conveyor path. The support belt has a minimal free length. The angle between the conveyor path and the support surface is essentially defined by the fastening locations and is advantageously small, which means that given an essentially horizontal conveyor path, the support surface is likewise roughly horizontal or is slightly askew in the direction of the conveyor path.

B The positioning roller is positioned at the largest possible distance to the conveyor path essentially over the first fastening location. The support belt extends with a free length which is larger compared to position A, from the first fastening location, steeply away from the conveyor path over the positioning roller to the second fastening location, wherein that part of the support belt which extends between the positioning roller and the second fastening location, forms the support surface. The angle between the conveyor path and the support surface is maximal, which means the support surface, given an essentially horizontal conveyor path, has a maximal steepness.

C The positioning roller is positioned on the other side of the first fastening location and is pressed against the support surface of a conveyor compartment which is adjacent on the conveyor compartment side of this fastening location. The support belt runs from the first fastening location away from the conveyor compartment around the positioning roller and from there back to the second fastening location, wherein again that part of the support belt which extends between the positioning roller and the second fastening location, forms the support surface. The support belt has a greater, free length than for the positions A and B of the positioning roller. The angle between the support surface and the conveyor path is determined by the positioning roller or by the fastening locations and is, in particular, roughly equally small as with the position A of the positioning roller.

The angles between the support surface and the conveyor path, which lie between the minimal and the maximal value, may of course also be set by way of positioning the positioning roller between the position B and C.

For the control of the positioning roller, the setting element, for example, comprises control rollers, which roll in corresponding stationary cams. The positioning roller is mounted, for example, in a resilient manner for the production of a pressing force in the position C of the positioning roller, said pressing force being independent of the thickness of the conveyed objects. If the pressing force is larger than the tensioning force of the tensioning means, the conveyor compartments are advantageously to be provided with suitable counter-elements for accommodating the mentioned pressing force.

BRIEF DESCRIPTION OF THE DRAWINGS

A few preferred embodiments of the conveyor device according to the invention are described in detail in combination with the following Figs. Thereby, there are shown in:

(FIG. 25: three-dimensional representation; FIGS. 28 and 29: section parallel to the conveyor direction);

DETAILED DESCRIPTION OF THE INVENTION

Figures 1, 2, 3:
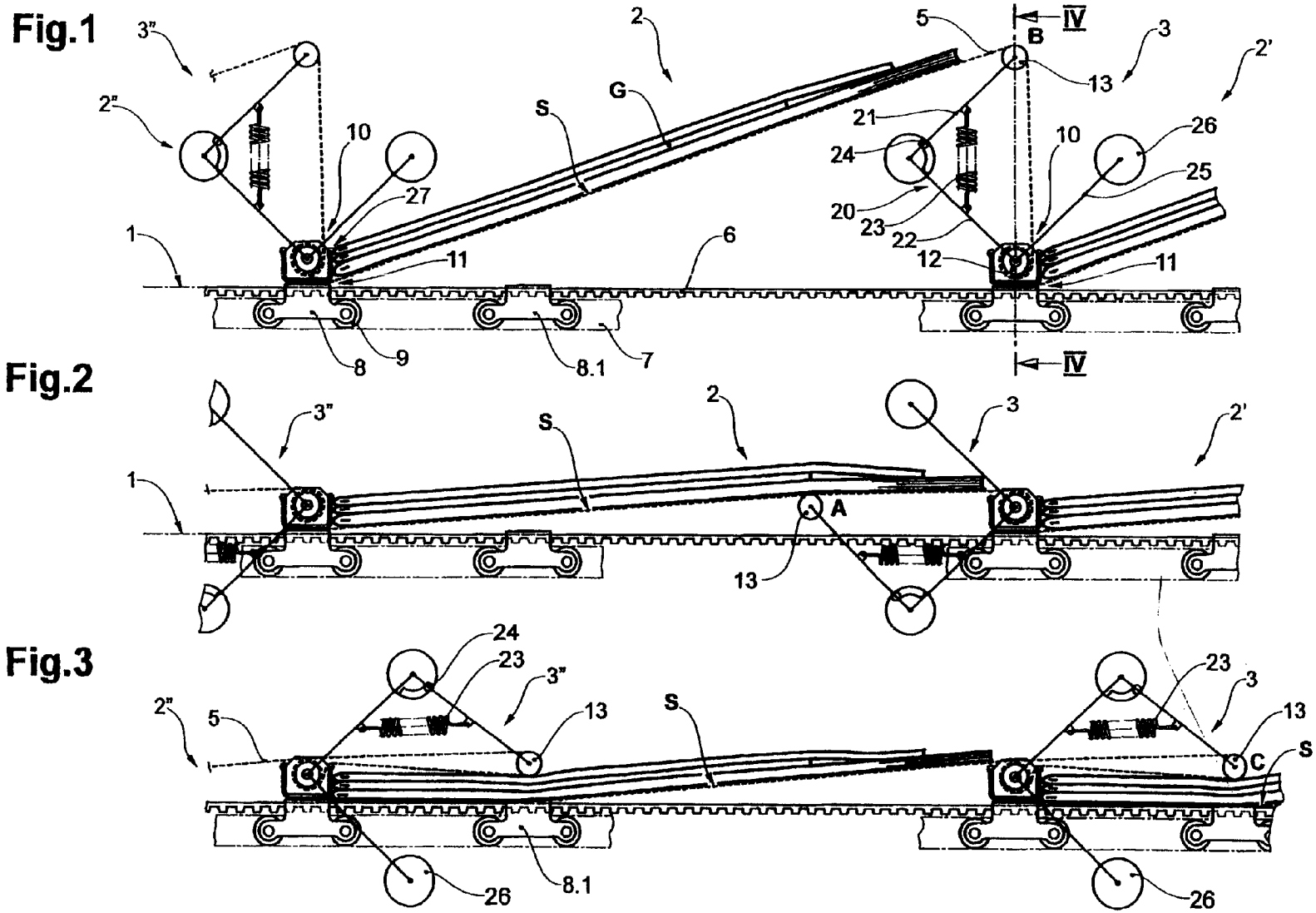
FIGS. 1 to 3 cut-outs from a first embodiment of the device according to the invention, with different conveyor compartment configurations (lateral views)

FIGS. 1 to 3 with regard to a first exemplary embodiment of the device according to the invention, show the functions of the setting elements of the conveyor compartments, in which flat objects G are conveyed lying on a support surface S.

The three FIGS. 1 to 3, in a lateral view, in each case show a small cut-out of a conveyor path 1, wherein the cut-out shows a complete conveyor compartment 2 with a setting element 3. Moreover, FIGS. 1 to 3 show parts of adjacent conveyor compartments 2' and 2", which connect to the conveyor compartment 2 on the side of the setting element 3 or on the other side. In FIGS. 1 to 3, the conveyor direction may be directed from right to left or from left to right.

The conveyor path 1 is defined by the course of a conveyor member 6. This course is determined by rails 7, along which roller bodies 8 with runner rollers 9 and which are fastened in a fixed manner on the conveyor member 6, are guided in a rolling manner. The conveyor member 6 is a toothed belt in the present case.

The conveyor compartment 2 (as with all conveyor compartments 2, 2', 2" etc. of the conveyor device) comprises a support belt 5 which is fastened on two roller bodies 8 which are arranged distanced to one another parallel to the conveyor path 1 (first fastening location 10 and second fastening location 11), in a manner such that the longitudinal edges or the length of the support belt 5 run in planes parallel to the conveyor path 1. The setting element 3 is pivotably fastened on the roller body 8 in the region of the first fastening location. A tensioning roller 12 or another suitable means, with which the support belt 5 is held under tension between the two fastening locations 10 and 11 independently of its free length, is advantageously likewise arranged in the region of the first fastening location 10.

The setting element 3 (as all setting elements 3, 3', 3" etc. of the conveyor device) essentially comprises a positioning roller 13, a means for moving the positioning roller 13 and a control means. The means for moving is, for example, a pivot lever 20, which in the region of the first fastening location 10 is pivotably fastened parallel to the conveyor path 1, for example on the roller body 8 of the first fastening location 10. The positioning roller 13 is mounted in a freely rotating manner and is advantageously resiliently mounted in the pivot lever 20. Advantageously, the pivot lever 20 is designed as a pair of twin levers which in each case are arranged laterally of the support belt 5, wherein the positioning roller 13 extends transversely to the conveyor path 1 and extends over this, and specifically on that side of the support belt 5, which faces away from the support surface S, and wherein the ends of the positioning roller 13 are mounted in each case in one of the twin levers. The pivot lever 20 is, for example, pivotable about the axis of the tension roller 12, but independently of this.

In the embodiment of the device according to the invention, represented in the FIGS. 1 to 3, the pivot lever 20 (that is to say the two twin levers) are designed as toggle levers with a distal limb 21 and with a proximal limb 22, wherein the positioning roller 13 is mounted on the distal limb 21, wherein the distal limb 21 is articulately connected to the proximal limb 22, and wherein a biased spring 23 and an stop 24 hold the two limbs 21 and 22 in an idle position with a minimal possible angle. The limbs 21 and 22 may be moved out of the idle position by way of a counter force whilst increasing the mentioned angle.

The setting element 3 as a control means, comprises, for example, a control lever 25 with a control roller 26 which is mounted thereon in a freely rotatable manner, wherein the control lever 25 is firmly connected to the pivot lever 20. The control roller 26, during the conveying, runs on a stationary cam (not shown), whilst the cam runs along the conveyor path and its distance to the conveyor path essentially determines the pivot position of the pivot lever 20 and, thus, the position of the positioning roller 13.

FIGS. 1 to 3 show how the first fastening location of a conveyor compartment 2 and the second fastening location 11 of an adjacent conveyor compartment 2' are arranged on a single roller body 8. Moreover, the same roller body 8 carries the setting element 3 and the tensioning roller 12 of the conveyor compartment 2. Additionally, in each case, an advantageously equally designed roller body 8.1, which serves as a counter element for accommodating the pressing force (see FIG. 3), may be arranged between the roller bodies 8 on which the mentioned elements of all conveyor compartments are fastened.

FIG. 1 shows the conveyor compartment 2 in a condition, in which the angle between the conveyor path 1 and the support surface S is as large as possible. The positioning roller 13 is in the position B described above, the pivot lever 20 is in its idle position (limb 21 on the stop 24) and extends away from the conveyor path 1. The objects G lie on the support surface S and are supported by a transverse wall 27 in the region of the second fastening location 11. The configuration of the conveyor compartment 2 show in FIG. 1 is suitable, in particular, for a collation path (see FIG. 5).

FIG. 2 shows the conveyor compartment 2 with an as flat as possible support surface S (smallest angle between the support surface S and the conveyor path 1), whose distance to the conveyor path in the region of the two fastening locations 10 and 11 is approximately equal. The positioning roller 13 is in its position A and deflects the support belt 5 between the fastening locations 10 and 11 to a very small extent or even not at all. The pivot lever 20 is in the idle position and extends towards the second fastening location 11, which means towards the actual conveyor compartment 2. The configuration of the conveyor compartment represented in FIG. 2 is in particular suitable for the transfer of objects (see FIG. 9).

FIG. 3 shows the conveyor compartment 2 with a smallest possible angle between the support surface S and the conveyor path 1, thus essentially as in FIG. 2, wherein however, in contrast to FIG. 2, the positioning roller 13 is not in the position A, but in the position C, which means that it acts on the adjacent conveyor compartment 2'. Thereby, the pivot lever 20 extends away from its own conveyor compartment 2, so that the steepness of the support surface S is again defined by the fastening locations 10 and 11, and the free length of the support belt 5 is the largest. The objects G which lie on the support surface of the conveyor compartment 2, are pressed by the positioning roller 13 of the conveyor compartment 2" connecting to the conveyor compartment 2" on the side of the second fastening location 11, against the conveyor surface S. The configuration of the conveyor compartment represented in FIG. 3 is suitable in particular for a conveying along a steep conveyor path or with support surfaces arranged above the objects.

By way of a suitable force exerted onto the control roller 26, which is accommodated by the support surface S or as represented, by a roller body 8 arranged on the press location, the positioning roller 13 is pressed against the objects G or, as the case may be, against the support surface S, wherein the distal limb 21 of the pivot lever 20 is moved against the force of the spring 23 away from the stop 24 to a greater or lesser extent, depending on the thickness of the objects.

Further embodiments of the device according to the invention which are not represented, differ from the embodiment represented in FIGS. 1 to 3, for example by way of the fact that a tensioning roller is provided instead of the positioning roller, that therefore the first fastening location is arranged on the pivot lever and, by way of this, is movable relative to the conveyor member, or by way of the fact that the tensioning roller is arranged in the region of the second fastening location 11.

Figure 4:
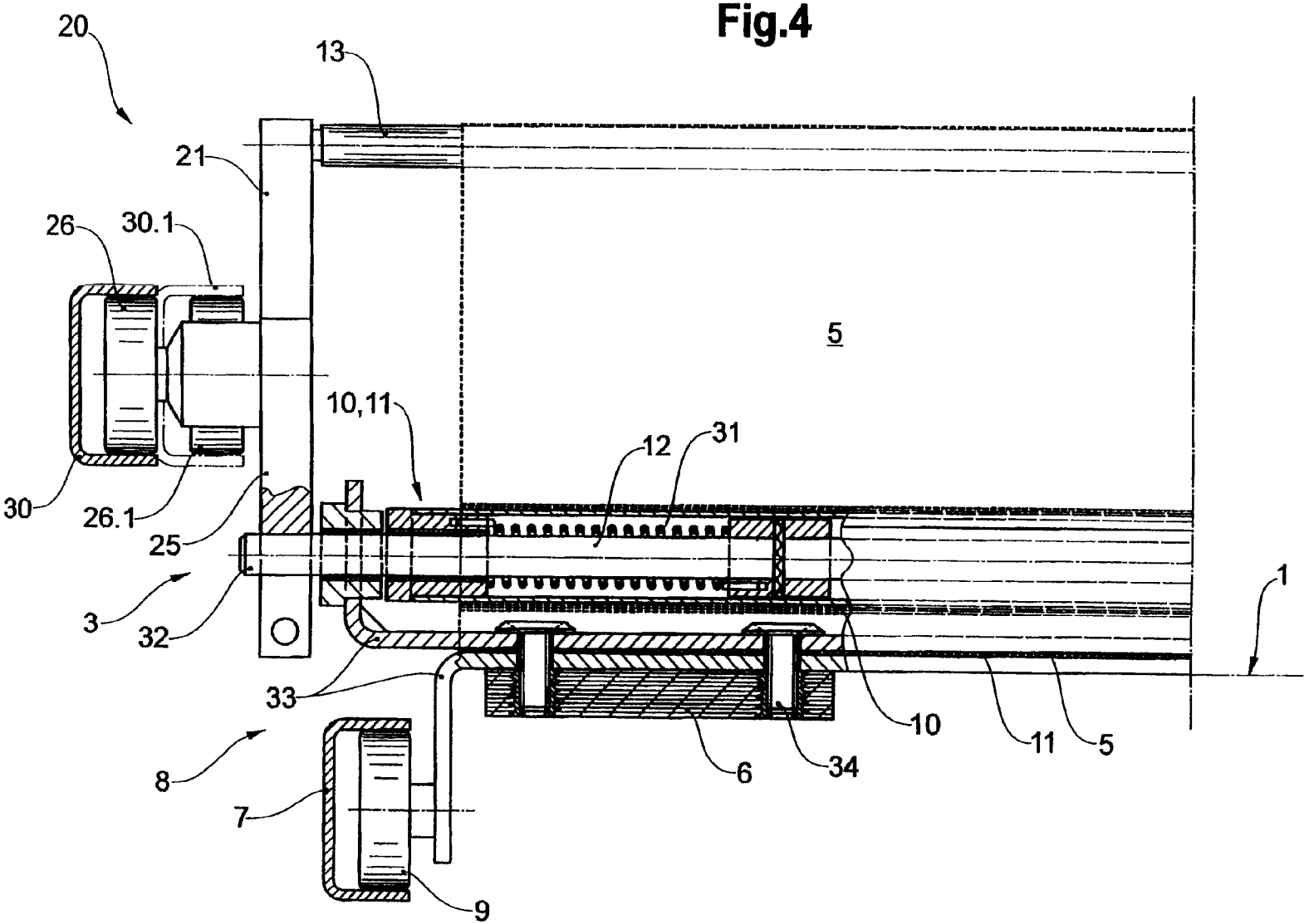
FIG. 4 a cross section through the embodiment according to FIGS. 1 to 3 (section line IV-IV in FIG. 1)

FIG. 4 shows the embodiment of the device according to the invention, which has already been described above with regard to FIGS. 1 to 3, sectioned transversely to the conveyor path 1, wherein only the one left half of the device is represented. In addition to the elements which have already been described with regard to the FIGS. 1 to 3, FIG. 4 also shows a stationary cam 30, in which the control roller arranged on the control lever 25 rolls, and whose distance to the conveyor path 1 determines the position of the positioning roller 13. As an alternative control means, a control roller 26.1 is drawn in and a corresponding cam 30.1. The alternative control roller 26.1 is arranged in the region of the toggle joint of the toggle lever 20, for example on a hinge bolt. For controlling the setting elements 3, it is of course also possible to arrange a control roller also in the region of the positioning roller 13 and to let this roll on a suitable cam (see also FIG. 8). There also exists the possibility of providing several control rollers per setting element, and to selectively provide guides for this in different sections of the conveyor path.

Moreover, FIG. 4, in more detail, shows the design of the tensioning roller 12 which by way of an inner tension spring 31, is held in a rotational position, in which as much as possible of the support belt 5 is wound thereon, and from which the support belt 5 may be unwound only against the spring force. The pivot shaft 32 of the pivot lever 20 is arranged coaxially to the tensioning roller 12 and the spring 31.

The section according to FIG. 4 lies in the region of a roller body 8, on which a first and a second fastening location 10 and 11 as well as the tensioning roller 12 and the setting element 3 are arranged. The roller body 8 consists essentially of two U-shaped profiles 33, which are fastened on the conveyor member 6 (toothed belt) by way of bolts or rivets 34. The one of the profiles 33 carries the runner rollers 9, the other the tensioning roller 12 and the actuation element 3. One end of a support belt 5 is fastened on the tensioning roller (first fastening location 10). An end of another support belt 5 is clamped between the two profiles (second fastening location).

FIGS. 5 to 8 show different sections of the conveyor path 1 of a conveyor device, for example according to FIGS. 1 to 4, wherein the setting elements 3 of the conveyor compartments 2 are set in a different manner in the different conveyor path sections, which means moved relative to the conveyor member 6 during the conveying.

Figure 5:
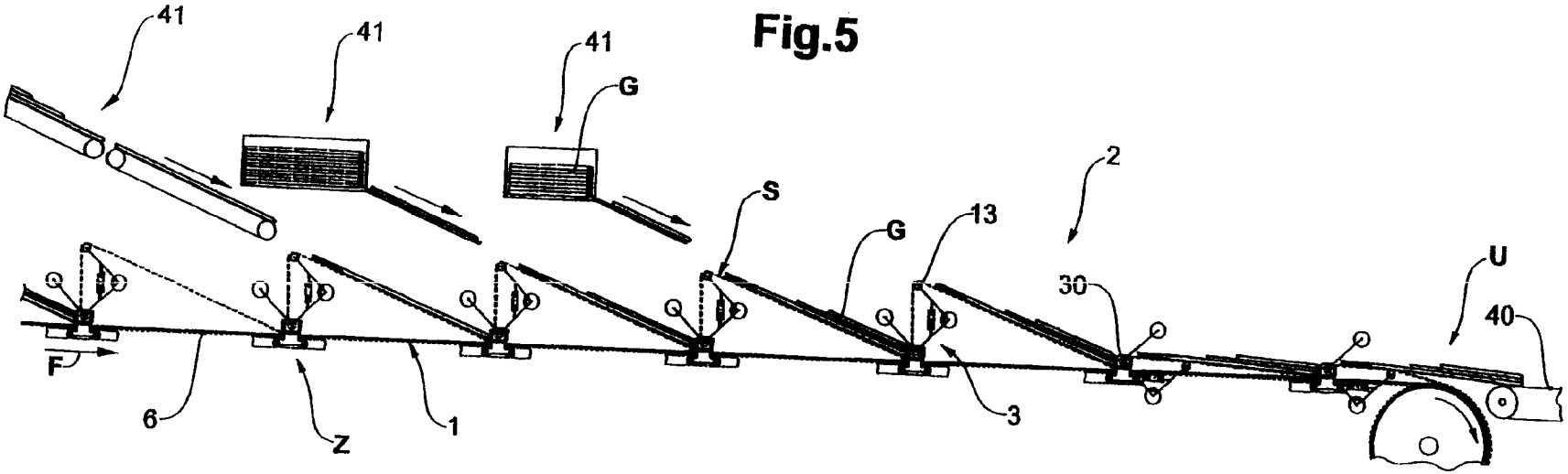
FIGS. 5 to 8 exemplary applications of the device according to the invention by way of lateral views of conveyor path sections of the device according to FIGS. 1 to 4.

FIG. 5 shows a collation path Z for creating stacks of printed products and/or other objects G in the conveyor compartments 2 of a device according to the invention, as is represented for example in FIGS. 1 to 4, as well as a transfer location U at which the collated printed products are transferred to a further conveyor device 40. On the collation path Z, the conveyor path 1 is horizontal for example, and the conveyor compartments 2 are arranged above the conveyor path 1. The conveyor direction F is such that the first fastening location 10 or the setting elements 3 form the trailing ends of the conveyor compartments 2. Feed locations 41 are arranged above the collation path Z, and are, for example, provided with feeders or means for on-line feeding. The feed directions have a component parallel to the conveyor direction F. The feed means are synchronised with the conveying of the conveyor compartments 2, in a manner such that in each case a printed product or another flat object is fed into each conveyor compartment 2 conveyed past below the feed locations 41, wherein the printed product for an alignment on the transverse wall 27 of the conveyor compartment, which is arranged at the front, with the feed has a somewhat greater speed than the conveyor compartment 2. On the feed path Z, the support surfaces S are set falling steeply to the front (positioning rollers 13 in position B). The positioning rollers 13 are pushed into the position A downstream of the last feed, by which means the steepness of the support surface S for the transfer of the printed products to the further conveyor device 40 which for example is a conveyor belt, is reduced. The transfer location U is described in more detail in combination with FIG. 9.

Figure 6:
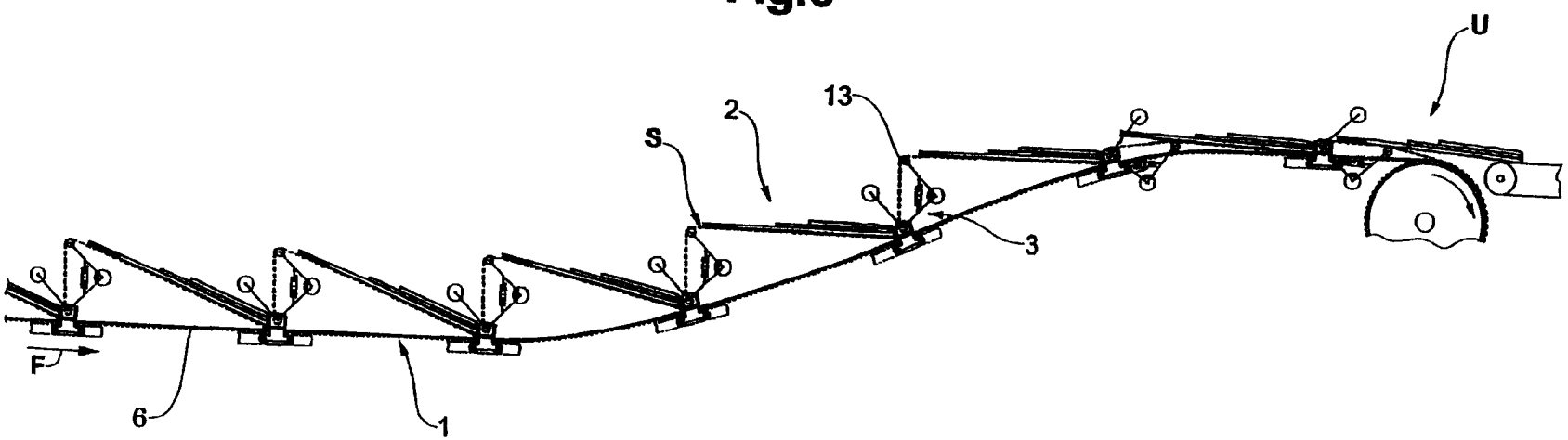

FIG. 6 shows a conveyor path section which leads towards a transfer location U, wherein the conveyor path 1 rises in front of the transfer location U. The conveyor direction F is directed equally as in FIG. 5. Before the incline, the conveyor path 1 is roughly horizontal, and the positioning rollers 13 are in position B. A horizontal alignment of the support surfaces S is set on the incline by way of the positioning rollers 13 being moved into a position between the positions A and B, in a manner such that the angle between the support surfaces S and the conveyor path 1 is as equally large as the gradient angle of the conveyor path 1.

Figure 7:
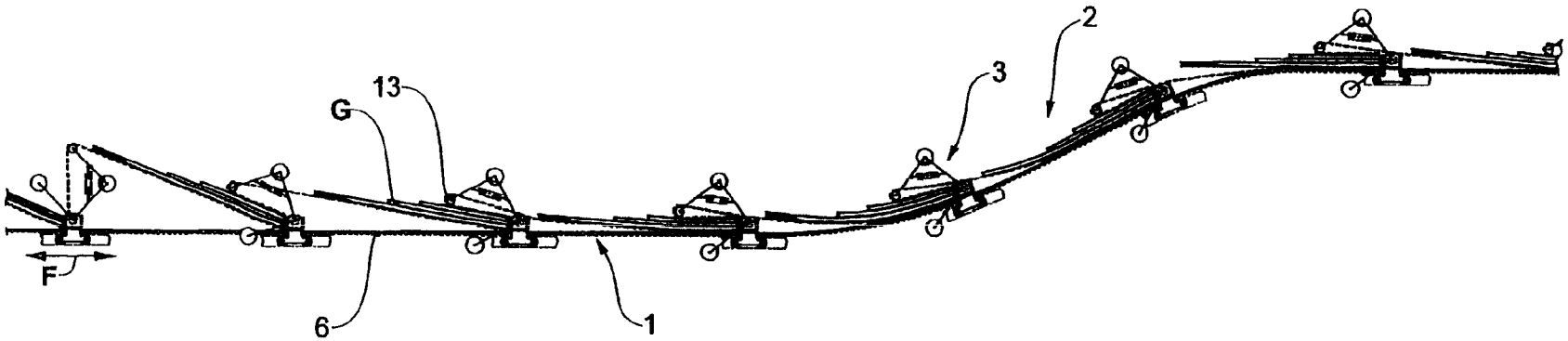

FIG. 7 shows a conveyor path section, in which the support surfaces are conveyed with small angles to the conveyor path 1 over an incline, and the objects G which are conveyed in the conveyor compartments 2 are pressed against the support surfaces S by way of the positioning rollers 13 of adjacent conveyor compartments. The conveyor direction F may be aligned from left to right or vice versa. With a conveyor direction from the left to the right, the positioning rollers 13 are firstly brought from position B into position C, wherein the angle between the support surface S and the conveyor path 1 reduces, and the positioning rollers 13 are pressed against the support surfaces S of adjacent (in the present case, trailing) conveyor compartments. In this configuration, the conveyor compartments 2 may not only be conveyed as shown over steeply rising or falling conveyor path sections, but they may also be conveyed in a converse manner, which means with support surfaces S arranged above the objects G to be conveyed.

Figure 8:
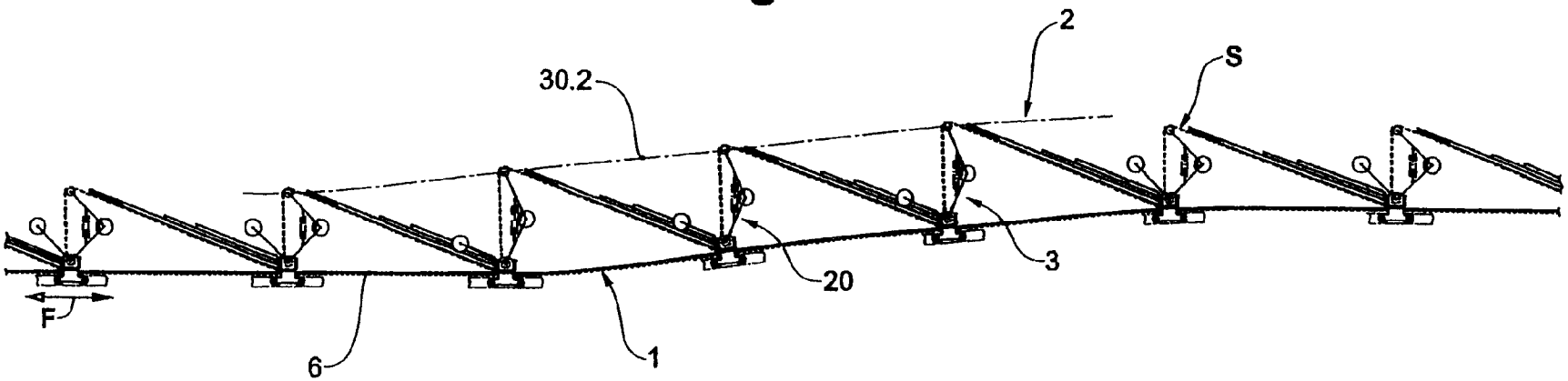

FIG. 8 shows a conveyor path section, in which the conveyor direction F may be directed from the left to right or the other way round. With a conveyor direction from the left to the right, the support surfaces S have a maximal angle to the conveyor path 1, which is essentially horizontal. If then the spatial steepness of the support surfaces S are to be retained on the following incline, the distance between the positioning rollers 13 and the conveyor path 1 must be increased further, for which a cam 30.2 engaging in the region of the positioning rollers is necessary, by way of which the pivot levers 20 are pulled out of their idle position and may be lengthened by way of this.

Figure 9:
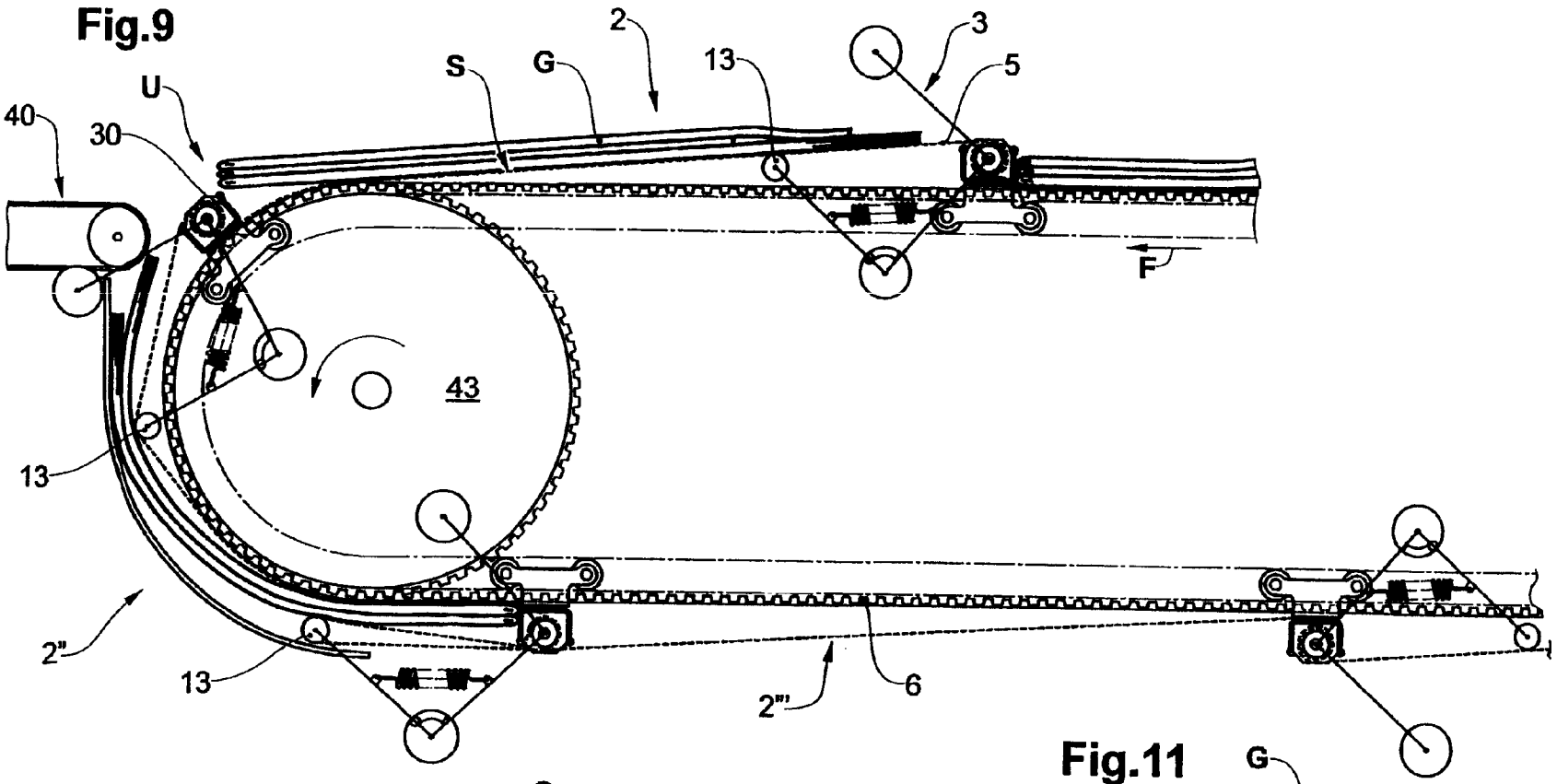
FIG. 9 an exemplary embodiment of a release location of the device according to FIGS. 1 to 4.

FIG. 9 in an enlarged scale shows a transfer location U at which, from a device according to the invention, as is represented, for example in the FIGS. 1 to 4, objects G conveyed in the conveyor compartments 2 are selectively transferred or not transferred to a further conveyor device 40, for example a conveyor belt, which means are discharged or led back. In the transfer location U, the conveyor compartments 2 are deflected about a relatively small deflection radius, downwards from an essentially horizontal conveyor path, for example by way of a toothed deflection roller 43, which is engaged with the conveyor member 6. A deflection radius which is very small in comparison to the length of the conveyor compartments 2 becomes possible due to the fact that the support belts 5 forming the support surfaces S are bendable and have a variable free length.

The conveyor compartments 2 are arranged relative to the conveyor direction in a manner such that the setting elements 3 are arranged at the trailing end of the conveyor compartments. The conveyor path section which is shown in FIG. 9 shows the conveyor compartment 2 directly in front of the transfer location U, and the leading adjacent conveyor compartment 2" in the deflection. The objects G which are conveyed in the conveyor compartment 2 are to be transferred and the objects conveyed in the leading conveyor compartment 2" were not transferred.

For this, the support surface S of the conveyor compartment 2 is set as little steeply as possible (positioning roller 13 in position A) and the positioning roller 13 of the leading conveyor compartment 2" is not in the position C, but likewise in the position A. By way of this, on deflection, the leading second fastening location of the conveyor compartment 2 and, thus, the transverse wall 27 is separated from a leading region of the objects G, so that these, assuming that they have a sufficient intrinsic stiffness, may be pushed onto the correspondingly arranged conveyor belt (further conveyor device 40).

The objects conveyed in the conveyor compartment 2" were not transferred in the transfer location U due to the fact that the positioning roller 13 of the conveyor compartment 2'" conveyed in front of the conveyor part 2" was already brought into the position C before the transfer location U, and is held in this position for the conveying about the defection and for the reverse conveying following the deflection.

The positioning roller 13 of the leading conveyor compartment 2'" is moved out of the position C towards the position B or A, at least so far until the objects may be removed, for letting go of non-transferred, which means discharged objects or for their transfer to another conveyor device.

For the selective transfer represented in FIG. 9, it is important for the setting elements to be designed in a manner such that the angle between the support surfaces S and the conveyor path 1 is essentially the same for the positions A and C of the positioning roller 13. Only thus is it possible for the objects to be able to be securely transferred out of a conveyor compartment independently of whether the objects are to be transferred in the trailing conveyor compartment or not.

Figure 10:
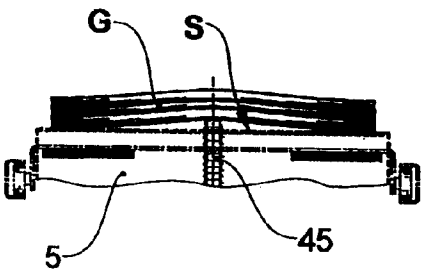
FIGS. 10 and 11 a cross section and lateral view of a further, exemplary embodiment of a support belt for the device according to the invention, for example according to FIGS. 1 to 4.
Figure 11:
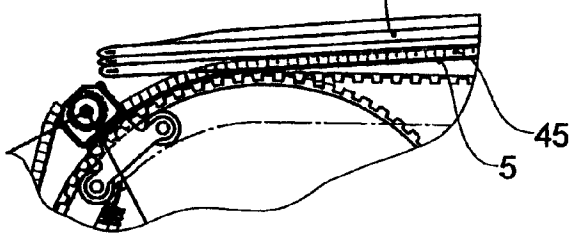

FIGS. 10 and 11 in a section transverse to the conveyor path and as a lateral view onto a transfer location, show a means with which the support belt is stiffened. The represented stiffening means extends on the side of the support surface S centrally along at least one part of the length of the support belt 5 and is only bendable in one direction, but is stiff in the other direction. The stiffening means consists, for example, of a series of cubic elements 45 which are arranged directly next to one another, which are fastened on the support side of the support belt 5 and which due to their arrangement prevent a bending of the support belt towards the support side, and prevent a bending away from the support side (e.g. by way of the positioning roller). The stiffening element represented in the FIGS. 10 and 11 largely prevents a sagging of the support surface and furthermore brings the flat objects conveyed in the conveyor compartment into a position bent parallel to the conveyor path. By way of this, the objects are also stiffer in this direction and slide better on the support surface.

FIGS. 12 to 15 shows exemplary guides 30, which cooperate with control rollers 26 of pivot levers 20 of the embodiment of the device according to the invention and according to FIGS. 1 to 4, for positioning the positioning roller 13. What is shown in each case is a setting element 3 with a pivot lever 20 in the form of a toggle lever with a distal and a proximal limb 21 and 22, which are biased against one another by way of a spring 23 and stop 24, and with a control lever 25 with a control roller 26, wherein the control roller rolls along the cam 30.

Figure 12:
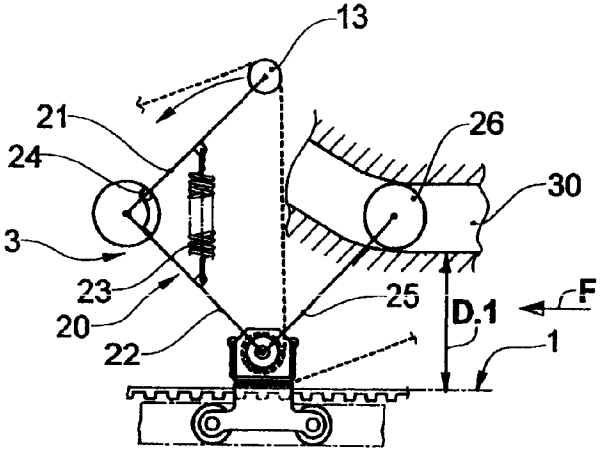

FIG. 12 shows the cam 30 in a conveyor path section, in which the positioning roller 13 is to be moved from the position A towards the position B. For this, the initial distance of the cam 30 to the conveyor path 1 is increased from a value D.1 which roughly effects a position B of the positioning roller 13. The respective movement of the positioning roller 13 is indicated with an arrow. The control roller 26 thereby rolls on the lower guide surface of the cam 30. With an opposite conveyor direction and a stop of the positioning roller 13 towards the position B from the side of the position A, the control roller 26 would roll along on the upper guide surface of the cam 30. On operation in only one direction, one may, as the case may be, leave out one of the represented control surfaces.

Figure 13:
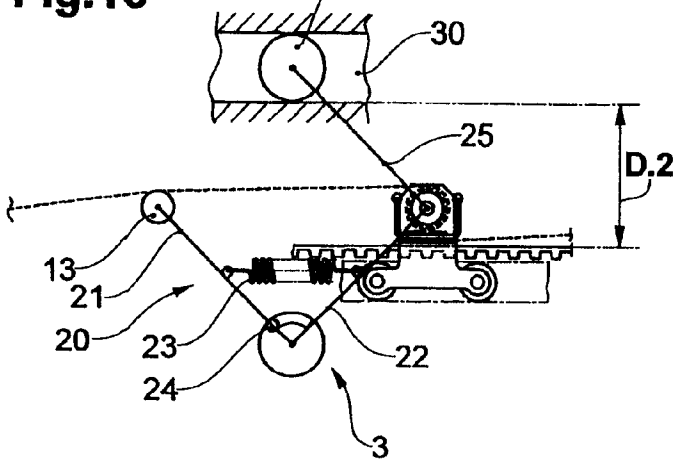

FIG. 13 shows a cam 30 with whose help the positioning roller 13 is held in the position A. The cam 30 has a constant corresponding distance D.2 to the conveyor path 1.

Figure 14:
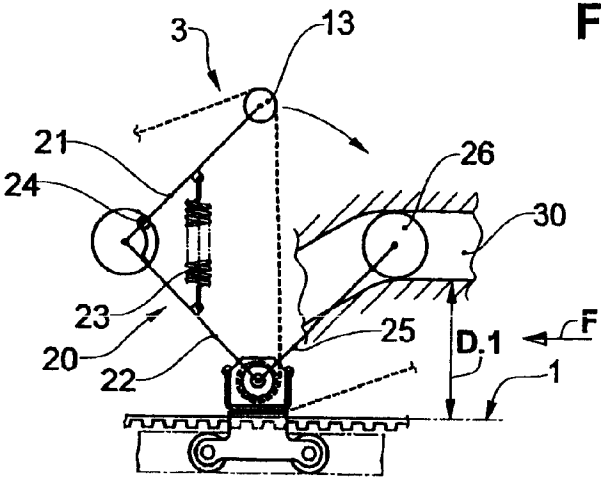
FIGS. 12 to 15 exemplary control means for controlling the setting elements of the device according to the invention, for example according to FIGS. 1 to 4.

FIG. 14 shows the cam 30 in a conveyor path section, in which the positioning roller 13 is to be moved from the position B towards the position C (arrow). For this, the initial distance of the cam 30 to the conveyor path 1 is reduced from a value D.1 (for position B), wherein the control roller 26 rolls on the upper control surface. With an opposite conveyor direction, the positioning roller 13 may be moved towards the position B (from the direction of the position C) and the control roller 26 rolls on the lower control surface. In this case too, on operation in only one direction, as the case may be, one may leave out the one of the guide surfaces of the cam 30.

Figure 15:
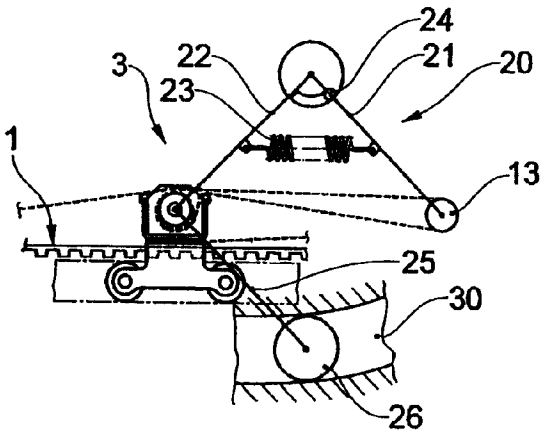

FIG. 15 shows a cam 30, with whose help the positioning roller 13 may be held in the position C. The cam runs on the opposite side of the conveyor path 1, wherein the distance between the cam 30 and the conveyor path 1 increased. By way of this, given a suitable thickness of the objects, the toggle joint of the pivot lever 20 is extended under the tension of the spring 23, wherein the positioning roller 13 remains in roughly the same position, but the pressing force on the objects to be pressed however increases.

Figure 16:
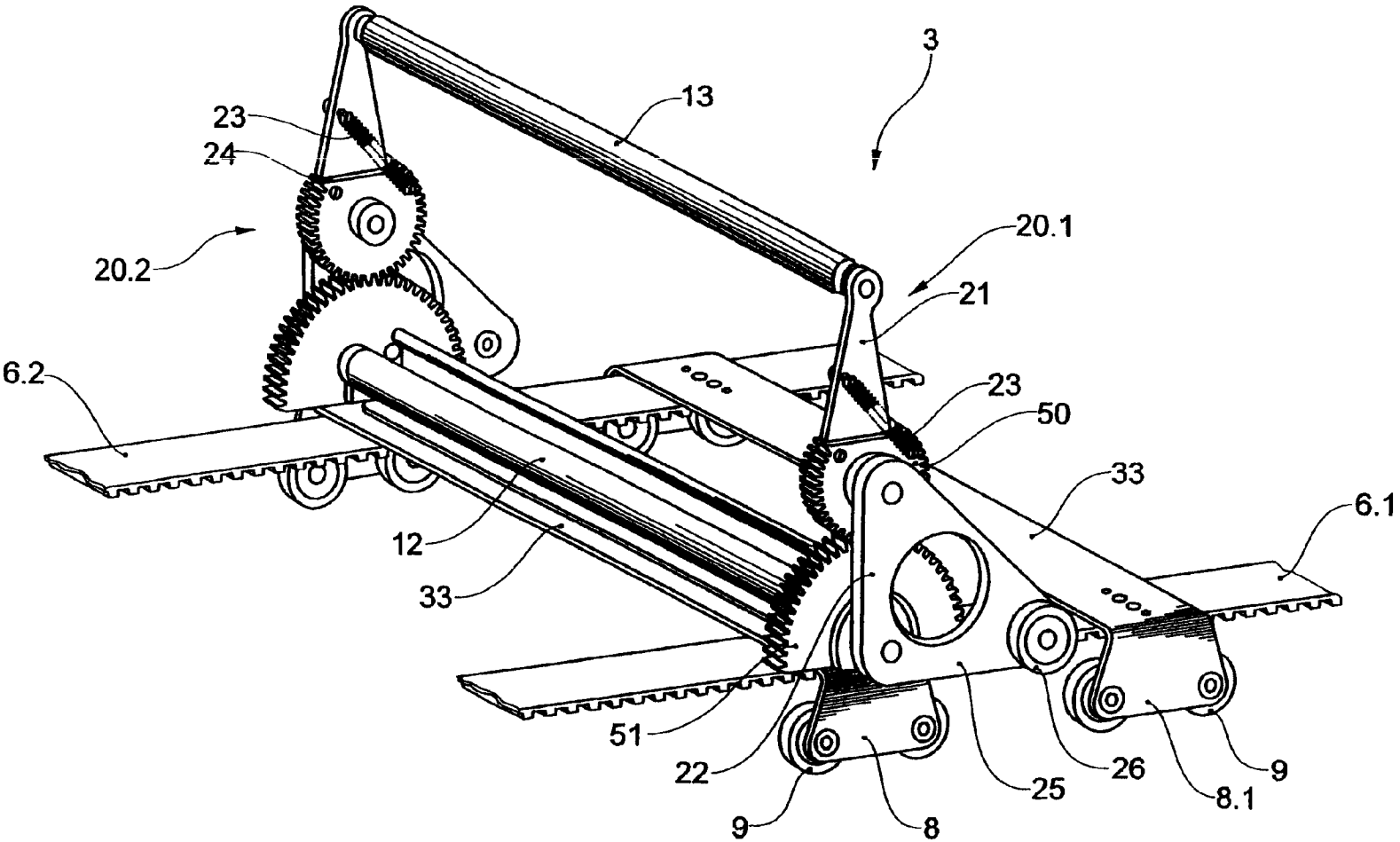
FIGS. 16 to 20 setting elements of a second embodiment of the device according to the invention.
Figure 17:
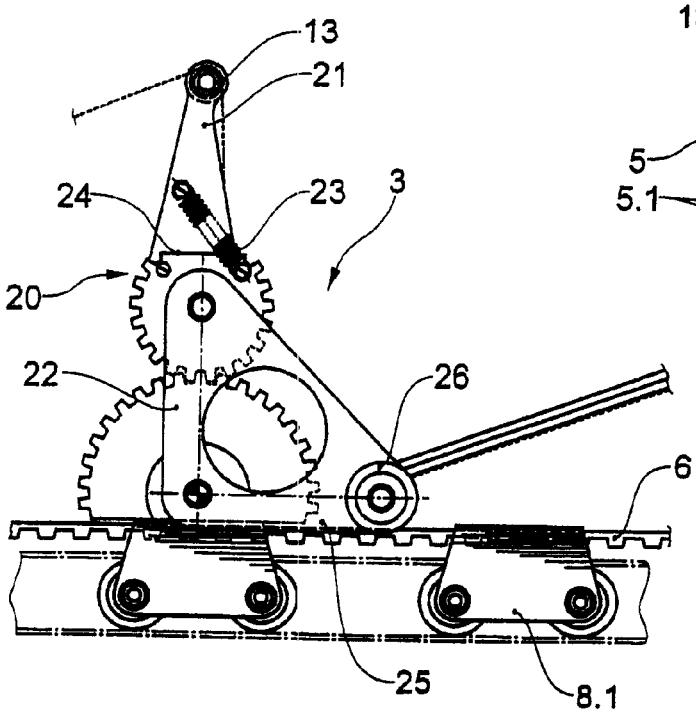
Figure 20:
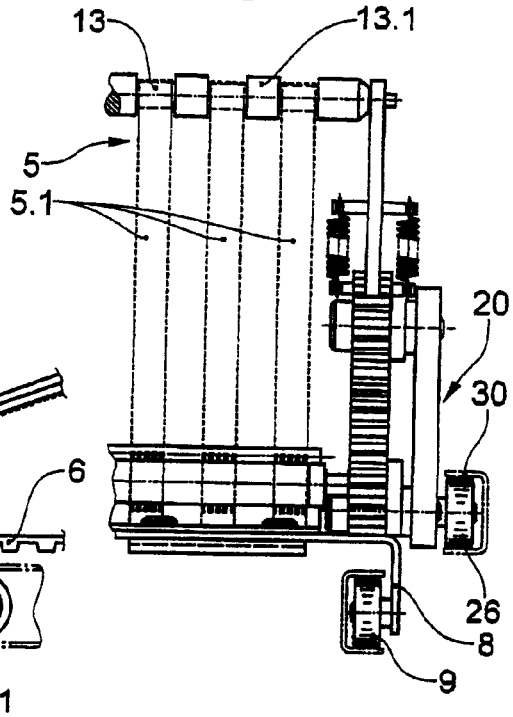
Figure 18:
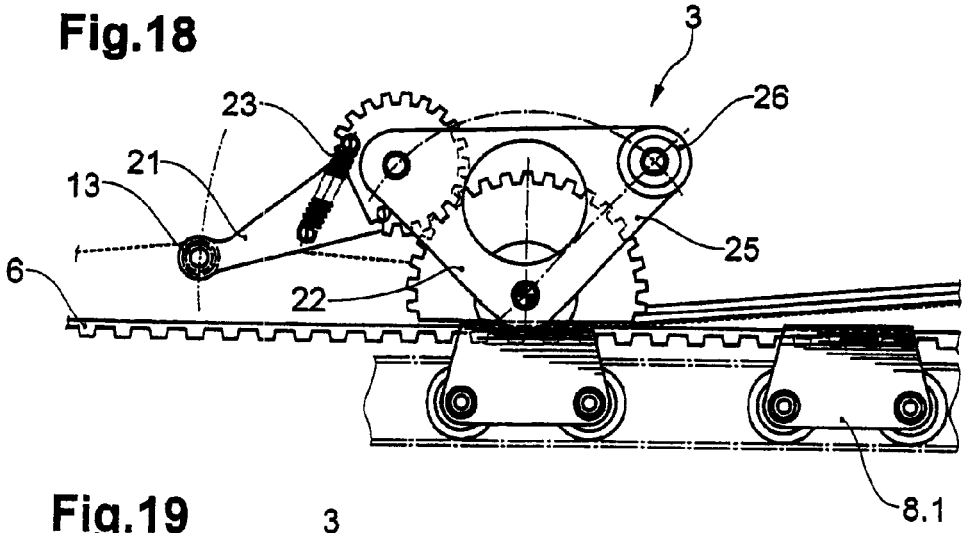
Figure 19:
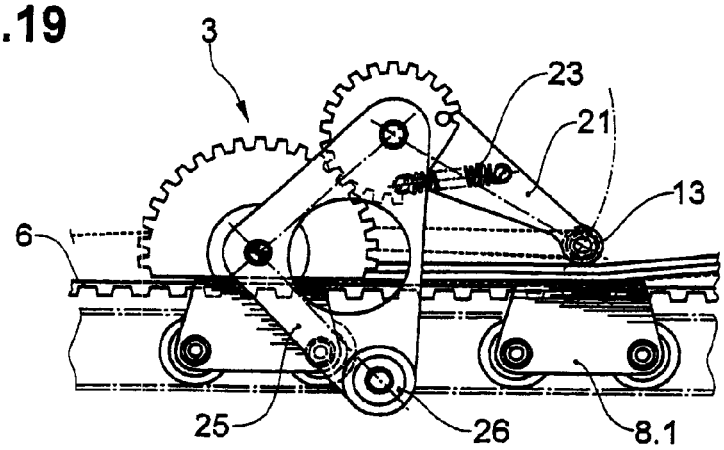

FIGS. 16 to 20 show a further exemplary embodiment of setting elements for the device according to the invention. FIG. 16 is a three-dimensional representation of a setting element 3, FIGS. 17 to 19 are lateral views of the setting element 3 with the positioning roller in positions B, A and C, and FIG. 20 is a section through the device transverse to the conveyor path. The setting element has the same function and largely equal parts as the setting element of the device according to FIGS. 1 to 4, wherein these equal parts are also indicated with the same reference numerals and are only yet described where necessary.

The differences of the setting element 3 according to FIGS. 16 and 20 and the setting element of the device according to FIGS. 1 to 4 lie in the design of the pivot lever 20 or of the twin levers 20.1 and 20.2. The pivot lever 20 comprises a distal limb 21 in which the positioning roller 13 is mounted, and a proximal limb 22, which together with the control lever 25 on which the control roller 26 is arranged, is pivotable relative to the conveyor member 6 (or 6.1 and 6.2). A toothed wheel 50 is mounted in a freely rotating manner on the proximal limb 22 and in a manner such that it is meshed with a toothed wheel 51 which is stationary relative to the conveyor member 6, or with a pivoting movement of the proximal limb 22, rolls on this. The distal limb 21 is pivotably arranged on the toothed wheel 50 and is biased by the spring 23 towards the stop 24. With a position change of the control roller 26, which rolls on a corresponding guide, the proximal limb is pivoted, the movable toothed wheel 50 rolls on the stationary toothed wheel 51 and accordingly displaces the distal limb 21, as this is evident from the FIGS. 17 to 19. In position C (FIG. 19), the positioning roller 13 is present on a suitably arranged roller body 8.1 which functions as a counter element, and with a further movement of the control roller 26, the distal limb 21 is pivoted away from the stop 24 under tension of the spring 23.

Also, a preferred embodiment of the conveyor member 6 and of the roller body 8 and 8.1 is evident from FIG. 16. The conveyor member consists essentially of two toothed belts 6.1 and 6.2 running parallel to the conveyor path and distanced to one another. The roller bodies 8 as already described with regard to FIG. 4, have a U-shaped profile 33, on which the runner rollers 9 are fastened. The roller body 8.1 has the same profile 33. The middle part of the profile 33 extends over the toothed belts 6.1 and 6.2 and is fastened on these, and the runner rollers are arranged on the outer profile parts. The U-shaped profiles have an as small as possible extension parallel to the conveyor path, so that the toothed belts 6.1 and 6.2 may be deflected about an as small as possible deflection radius.

A comparison of the FIGS. 12 to 15 with the FIGS. 17 to 19, shows that with regard to the setting element 3 comprising the toothed wheels 50 and 51, the paths of the control rollers 26 are significantly smaller, without the force effort being larger, which represents an advantage with regard to the guides 30.

FIG. 20 shows the setting element 3 according to the FIGS. 16 and 19, partly in section transverse to the conveyor path. A particularly advantageous embodiment of the support belt 5 and of the positioning roller 13 is also evident from this figure. The support belt 5 consists of a plurality of part belts 5.1 which are distanced to one another. The positioning roller 13 comprises rings 13.1, which are arranged distanced to one another along the axial length of the positioning roller 13 and are arranged freely rotating relative to this, at least in a limited manner. The distances between the rings 13.1 are adapted to the width of the part belts 5.1, and the axial width of the rings is adapted to the distances between the part belts 5.1, in a manner such that the part belts 5.1 may be positioned on the positioning roller 13 between the rings 13.1, and the rings 13.1 project beyond the part belts 5.1. The function of the rings 13.1 is limited to the position C of the positioning roller 13, in which the objects as the case may be, may be moved relative to the positioning roller 13 to be pressed, whereas the position of the support belt 5 running over the positioning roller 13, however, remains unchanged relative to the positioning roller 13. This means that the positioning roller should roll on the objects to be clamped, but not on the support belt 5. The mentioned two functions of the positioning roller are separated from one another in position C with the positioning roller 13 according to FIG. 20. The positioning roller 13 itself rolls on the support belt 5 or on the part belts 5.1, whilst the rings 13.1 may roll on the pressed objects given a rotational position of the positioning roller 13 which remains the same.

Figure 21:
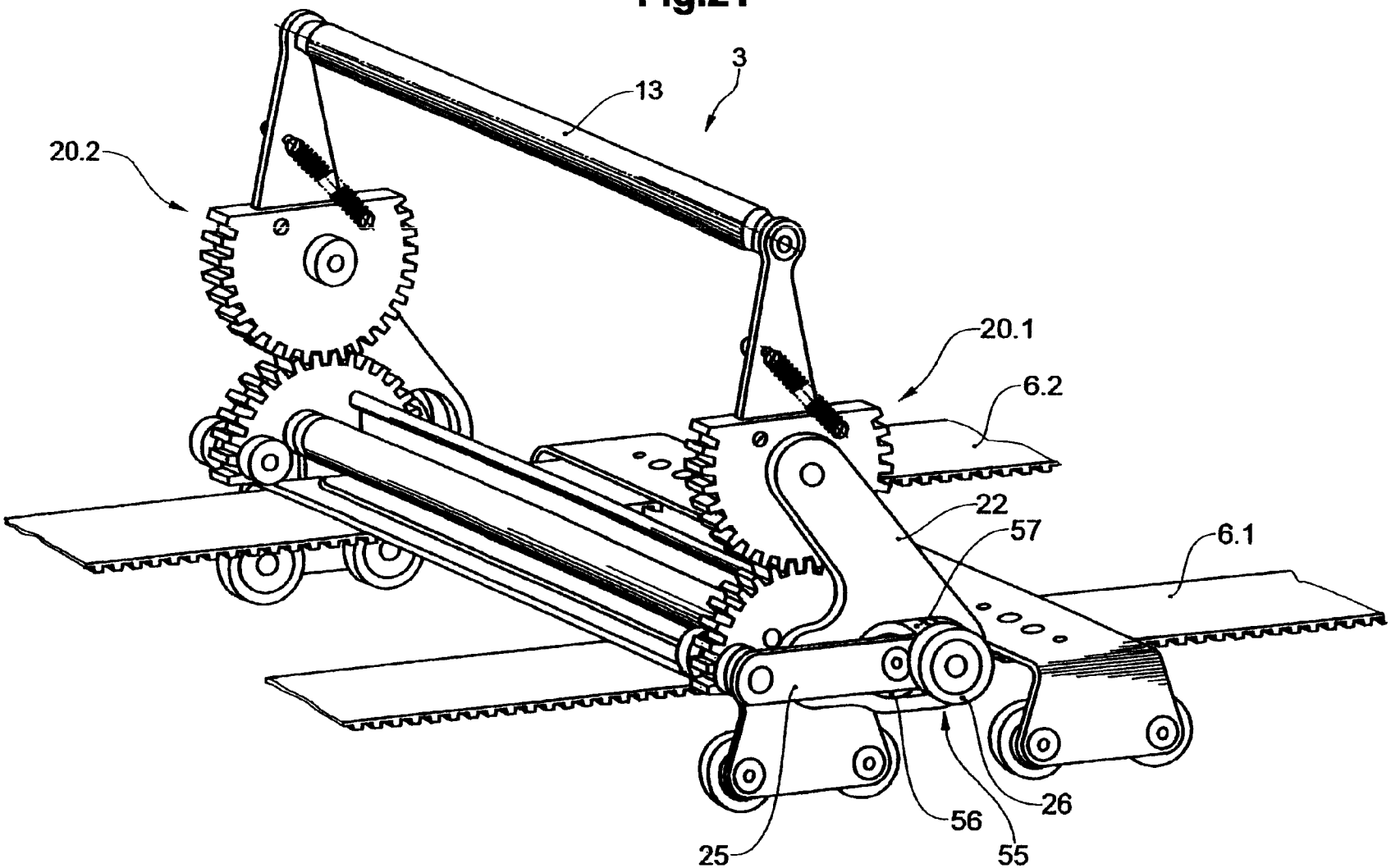
FIGS. 21 to 25 setting elements of a third embodiment of the device according to the invention.
Figure 22:
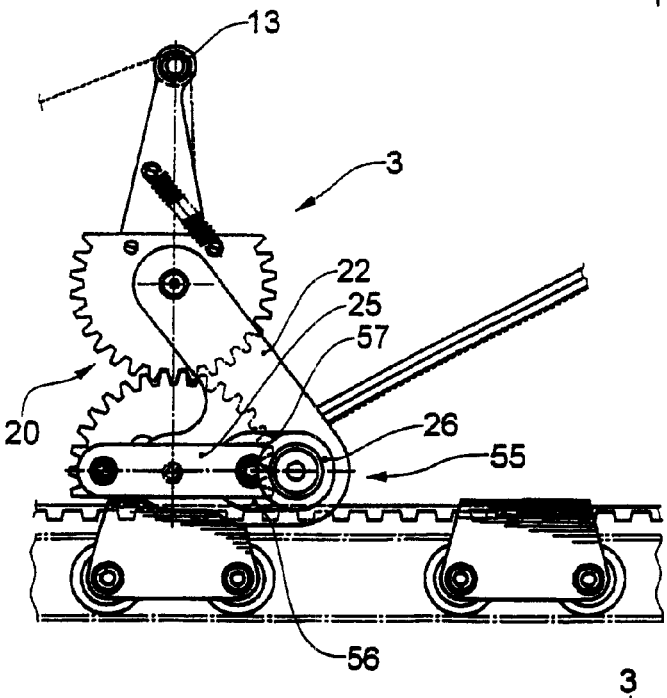
Figure 25:
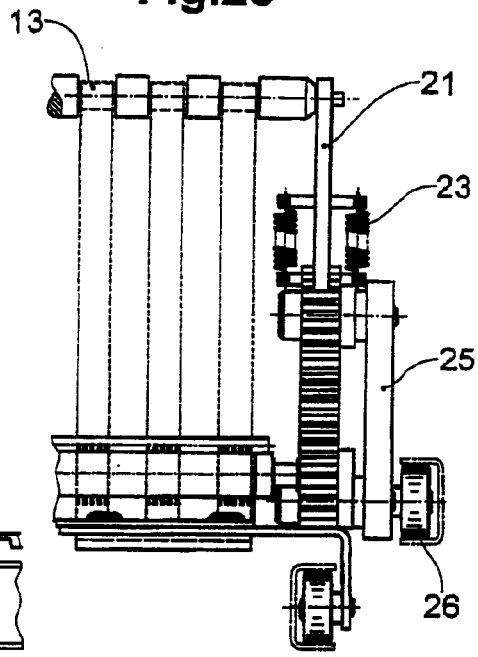
Figure 23:
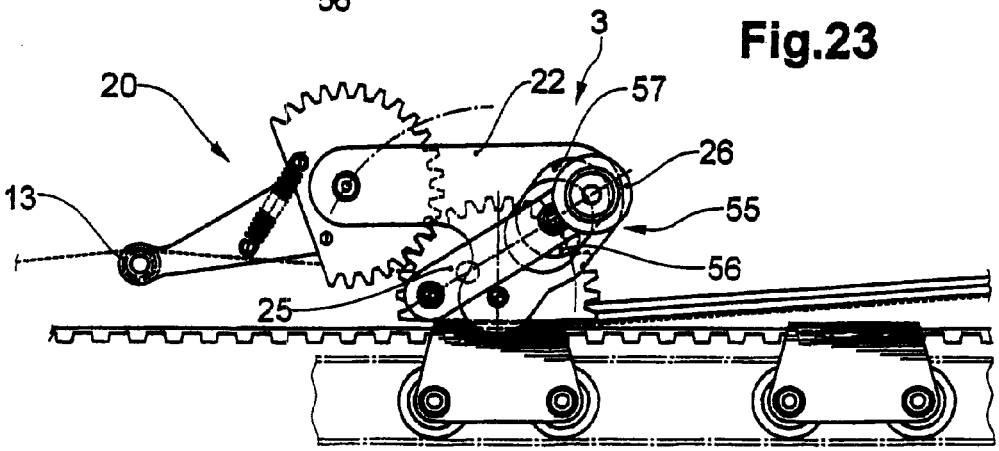
Figure 24:
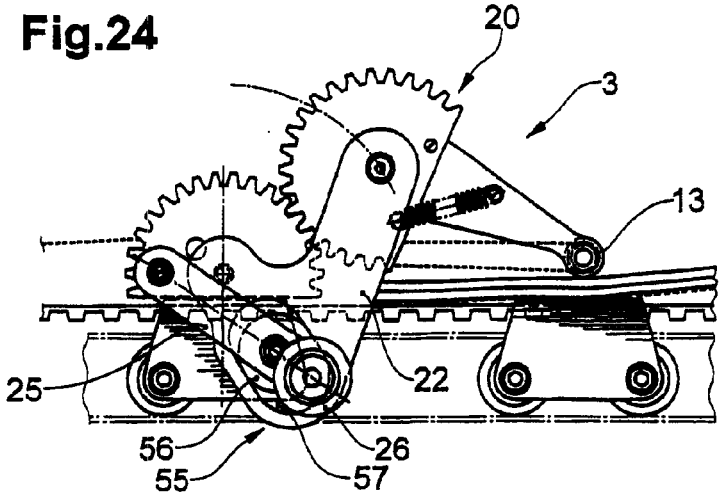

FIGS. 21 to 25 show a further embodiment of the setting elements 3 for a device according to the invention. FIG. 21 is a three-dimensional representation of a setting element 3, FIGS. 22 to 24 are lateral views of the setting element with the positioning roller 13 in positions B, A, and C, and FIG. 25 is a section through the device transverse to the conveyor path. The setting element 3 has the same function and largely the same parts as the setting element 3 of the device according to FIGS. 16 to 20, wherein these same parts are also indicated with the same reference numerals and are only described where still necessary.

The setting element 3 according to FIGS. 21 and 22 differs from the setting element according to FIGS. 16 and 20 by way of the design of the control lever 25 and the proximal limb 22 of the pivot lever 20. Whereas in the setting element 3 according to FIGS. 16 to 20, the control lever 25 and the proximal limb 22 are pivoted together about the same pivot axis, the control lever 25 and the proximal limb 22 of the setting element 3 according to the FIGS. 21 to 25 have two pivot axes being parallel and distanced to one another, and are coupled to one another via a sliding joint 55. A hinge bolt 56 arranged in the region of the control roller 26 on the control lever 25, given a displacement of the control roller 26, displaces in a slot-like opening 57 of the proximal limb 22

The setting element 3 according to FIGS. 21 to 25 has even smaller control paths for the control roller 26, wherein here one does not expect greater control forces.

Figure 26:
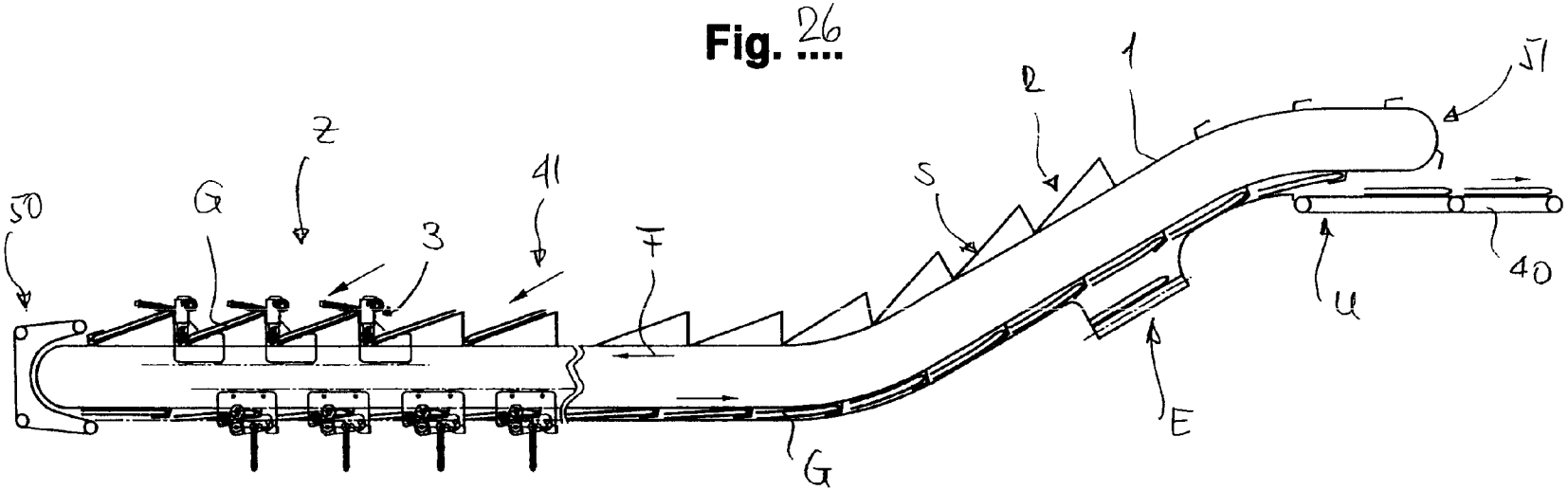
FIG. 26 the conveyor path of a fourth embodiment of the device according to the invention (lateral view)

FIG. 26 shows an exemplary conveyor path 1 of a further, exemplary embodiment of the conveyor device according to the invention. The conveyor path 1, along which the conveyor compartments 2 are conveyed with trailing setting elements 3, again comprises a collation path Z with feed locations 41, at which in each case an object G is released into each conveyor compartment 2. For this, the support surfaces S of the conveyor compartments 2 are in their steepest position (position B of the positioning rollers). A first deflection 50 about approx. 180° follows the collation path Z, in a manner such that after the deflection 50, the support surfaces S lie above the objects G (reverse conveying), and the objects, thus, need to be held in the conveyor compartments 2. For this, the setting elements 3 before the first deflection 50 are brought into the clamping position (position C of the positioning rollers), in which they clamp the objects against the support surface of each trailing conveyor compartment. The transfer location U at which the objects G are transferred to a further conveyor device 40, are deflected by approx. 180° at the end of the reverse conveying, which means before the second deflection 51.

The further conveyor device 40 is, for example, a conveyor belt arranged below the conveyor path 1 of the conveyor compartments 2, onto which the objects G are deposited by way of the fact that the setting element 3 of the leading conveyor compartment is brought into a position which is close to position C but is not clamping, or is brought directly into the position B.

Moreover, a discharge location E may be arranged between the first and the second deflection, thus in the region of the reverse conveying, in which location the control means (not represented) are provided, with which the setting elements 3 may be moved out of the position C, and means for capturing the objects, which are let go by way of this, for example as objects which are detected as being incomplete, damaged or not meeting other demands, and are thus to be discharged.

The embodiment according to FIG. 26 compared to the embodiment of the device according to the invention, as has been described in combination with the FIGS. 1 to 9, has two advantages. Firstly, the transfer to the transfer location U at which the objects are conveyed in a reverse manner, also functions with objects which only have a very low intrinsic stiffness, which may lead to difficulties for the transfer U according to FIG. 9. Secondly, a position A of the setting elements 3 is not necessary, by which means these may be designed in a simpler manner (see FIGS. 27 to 29).

Figure 27:
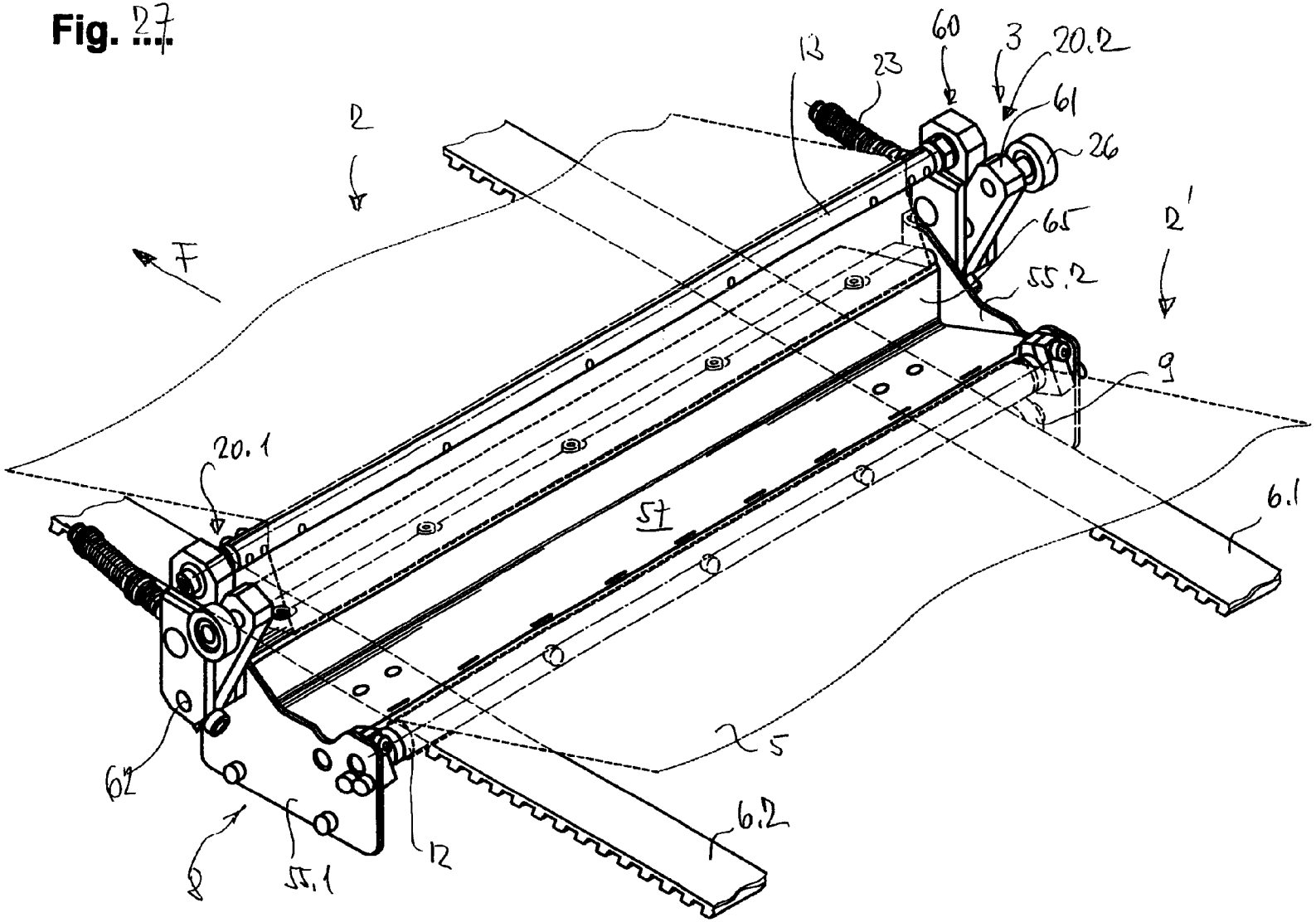
FIGS. 27 to 29 a roller body with a setting element of the embodiment according to FIG. 26
Figure 28:
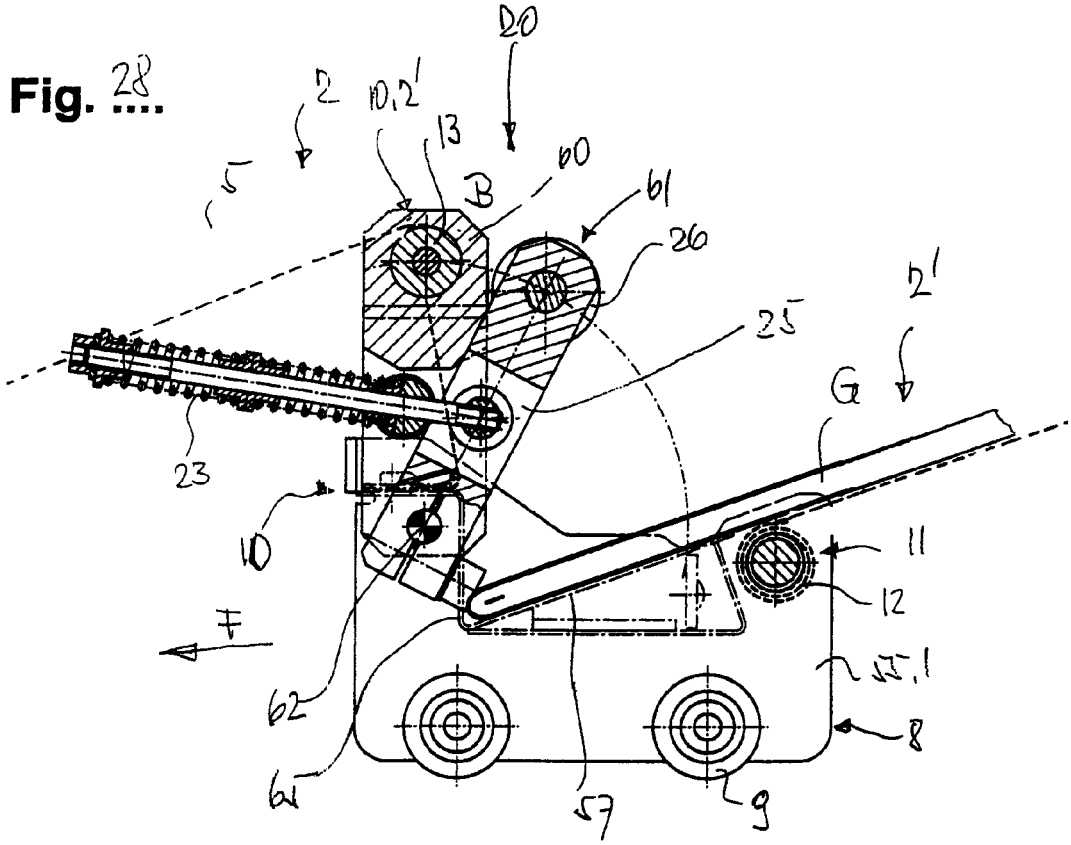
Figure 29:
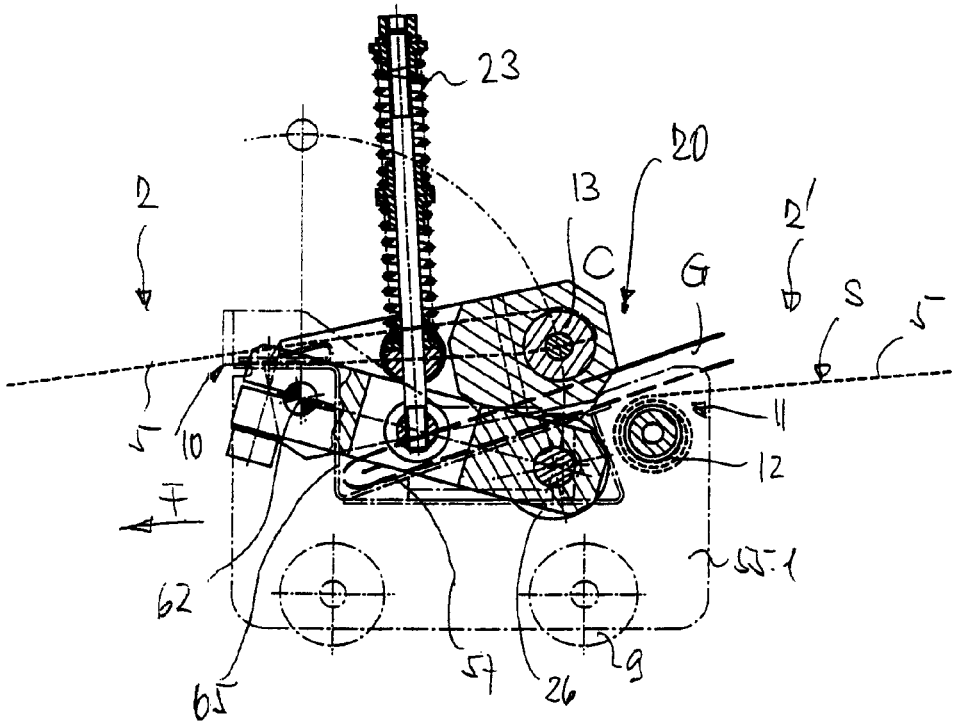

FIGS. 27 to 29 show a roller body 8 for the embodiment of the device according to the invention, as is shown in FIG. 26. In FIG. 27, the roller body 8 is represented in a three-dimensional manner, and in FIGS. 28 and 29, in the section parallel to the conveyor direction F (FIG. 28: positioning roller in position B; FIG. 29: positioning roller in position C). The roller body 8 comprises two side parts 55.1 and 55.2 and a transverse part 57 which connects the side parts and which is fastened on two toothed belts 6.1 and 6.2 (transport member) with suitable means. Moreover, as on the roller bodies of the already previously described embodiments of the device according to the invention, the following elements are assembled on the roller body: the setting element 3, the first fastening location 10, the second fastening location 11 of the adjacent conveyor compartment, which in the present case comprises the tension roller 13, and a plurality of runner rollers 9.

The setting element 3 again comprises twin levers 20.1 and 20.2 which are arranged in each case on one side of the support belt 5 and which are pivotably mounted in the side parts 55.1 and 55.2 of the roller body 8. Each of the twin levers 20.1 and 20.2 comprises a setting limb 60 and a control limb 61 which are both pivotable about the same axis 62. The two limbs 60 and 61 are connected to one another via a biased spring 23 and are pivotable independently of one another to a limited extent about the axis 62 against the force of this spring. The control lever 61 carriers a control roller 26, which rolls in a cam (not shown) which defines the pivot position of the control lever. The setting lever 60 carries the positioning roller 13.

FIGS. 28 and 29 show the position B of the positioning roller 13, in which the support surface S is steepest relative to the conveyor path, and the position C of the positioning roller 13 in which this is pressed against the support surface S of an adjacent conveyor compartment 2' or against objects G positioned on this support surface, in order to hold them in the conveyor compartment 2', for example with a reverse conveying.

In the position B of the positioning roller 13, the setting limb 60 is aligned roughly at right angles to the conveyor direction F, and the distance perpendicular to the conveyor direction between the positioning roller 13 and the second fastening location 11 is as large as possible and thus the angle between the conveyor path 1 and the support surface S is maximal. By way of pivoting away the control limb 61 and the setting limb 60 which is connected thereto via the spring 23, against the adjacent conveyor compartment 2', the positioning roller 13 is moved against the adjacent conveyor compartment 2' and under compression of the spring 23, it is pressed against the support surface S of this conveyor compartment 2', with which its position C is reached.

Differently to the previously described embodiments of the device according to the invention, the first fastening location 10 of the conveyor compartment and the second fastening location 11 of the adjacent conveyor compartment 2' are distanced to one another, and in this region the transverse part 57 of the roller body 8 assumes the function of the support surface S and has a steepness, which corresponds to the steepness of the support belt 5 at the position B of the positioning roller 13. The setting lever member 60 thereby is dimensioned in a manner such that the positioning roller 13 in its position C does not reach onto the support belt 5, but is pressed against the transverse part 57. With this, the arrangement of a further roller body in the region of the press location becomes superfluous, as has been described in the context of FIG. 3. The transverse part 57 of the roller body 8 may also assume the function of a front wall 65 of the conveyor compartments, on which the objects fed to the feed locations may be aligned.

Differently to the previously described embodiments of the device according to the invention, for which also the position A of the positioning roller 13 is possible or necessary, in the embodiment according to FIG. 26, only the position B and C of the positioning roller 13 are required. By way of this, the belt length between the first fastening location 10 and positioning roller always remains the same. The tensioning roller 12 in this case is advantageously arranged on the second fastening roller 11, so that the positioning roller 13 does not need to roll on the support belt 5. It is then possible and advantageous to fasten the support belt 5 on the positioning roller 13, or to use the positioning roller 13 as a first fastening location (not shown) at all. The positioning roller 13 represented in FIGS. 27 to 29 consists of two half rollers, between which the support belt 5 is clamped and firmly held by way of this. Moreover, the positioning roller 13 is not freely rotatable but is fixed in its rotation position at the side parts 55.1 and 55.2 of the roller body 8. It would also be possible to apply a positioning roller 13 with a cross section different to the round cross section.

Figure 30:
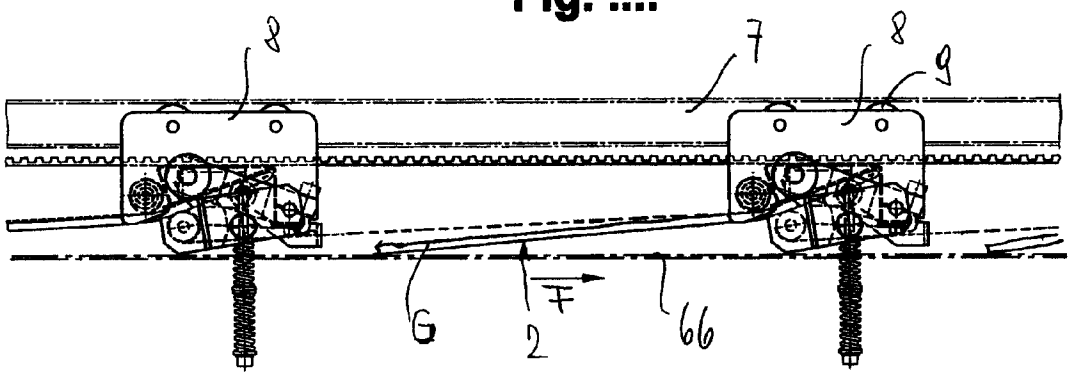
FIG. 30 a conveyor path cut-out with a downwardly directed conveying, of the embodiment according to FIGS. 26 to 29.

FIG. 30 in a somewhat larger scale than FIG. 26 shows the reverse conveying (conveying with the support surface above the conveyed objects) with the device, as is described in the context of FIGS. 26 to 29. From this, one may also see the rails 7, in which the runner rollers 9 of the roller bodies roll, as well as a lower guide 66, by way of which the free ends of the objects G firmly held in the conveyor compartments 2 are guided.

Most features which are described in the above description for the specific embodiments of the device according to the invention may be used in an adapted manner also for other embodiments. The man skilled in the art, with the knowledge of the invention, is capable of realising other feature combinations without further ado.

The invention claimed is:

1. A conveyor device for conveying flat objects (G), said conveyor device comprising:

a plurality of conveyor compartments (2) which may be moved one after the other along a conveyor path (1) defined by a conveyor member (6) or by way of rails (7), wherein each conveyor compartment (2) comprises a support surface (S) and wherein an angle between the support surface (S) and the conveyor path (1) may be set, wherein each conveyor compartment (2) comprises a support belt (5) with a length between two belt ends and with a width extending transversely to the conveyor path (1), as well as with a surface of the support belt (5) forming the support surface (S) and an oppositely lying surface of the support belt (5), which lies opposite to the support surface, and wherein the support belt (5) may be bent longitudinally at least against and towards the oppositely lying surface, and wherein the belt ends are fastened on two fastening locations (10, 11) which are spaced from one another and parallel to the conveyor path (1).

2. A conveyor device according to claim 1, wherein each conveyor compartment (2) comprises a setting element (3) for setting the angle between the support surface (S) and the conveyor path (1), which is designed in order, engaging on the support belt (5), to change its course between the fastening locations (10, 11), and that each conveyor compartment (2) comprises a tensioning means for tensioning the support belt (5).

3. A conveyor device according to claim 2, wherein the setting elements (3) are additionally designed, in order to press objects conveyed in adjacent conveyor compartments (2') against the support surface (S).

4. A conveyor device according to claim 3, wherein the two fastening locations (10, 11) have a fixed distance to one another parallel to the conveyor path (1), and transverse to the conveyor path (1) have fixed distances to the conveyor path (1), and that the setting element (3) in a belt region between the fastening locations (10, 11) engages on the oppositely lying surface of the support belt (5).

5. A conveyor device according to claim 4, wherein the setting element (3) comprises a positioning roller (13) with an axis which is aligned parallel to the width of the support belt (5), and that the positioning roller (13) is movably arranged in a manner such that its distance to the conveyor path (1) and its distance to the fastening locations (10, 11) may be varied parallel to the conveyor path (1).

6. A conveyor device according to claim 5, wherein the positioning roller (13) is movable along an essentially circular-arc shaped movement path, and wherein the movement path lies in a plane parallel to the conveyor path (1) and its middle point is arranged in the region of a first (10) of the two fastening locations (10, 11).

7. A conveyor device according to claim 6, wherein the tensioning means is a resiliently rotatable tensioning roller (12).

8. A conveyor device according to claim 7, wherein the tensioning means is arranged in the region of the first fastening location (10 or 11).

9. A conveyor device according to claim 7, wherein the positioning roller (13) is arranged on a pivot lever (20) in a freely rotating manner.

10. A conveyor device according to claim 9, wherein the pivot lever (20) is pivotable about an axis of the tensioning roller (12).

11. A conveyor device according to claim 9, wherein the pivot lever (20) comprises two twin levers (20.2 and 20.2) arranged in each case laterally of the support belt (5).

12. A conveyor device according to claim 9, wherein the pivot lever (20) is a toggle lever, which comprises a proximal limb (22) and a distal limb (21) which carries the positioning roller (13), wherein the two limbs (22, 21) are held in a biased idle position with the help of a spring (23) and a stop (24).

13. A conveyor device according to claim 12, wherein a freely rotating first toothed wheel (50) is arranged on the proximal limb (22) and that a second toothed wheel (51) is firmly arranged on the conveyor compartment (2), in a manner such that it is in engagement with the first toothed wheel (50).

14. A conveyor device according to claim 9, wherein the pivot lever (20) is actively connected to a control lever (25) and that the control lever (25) comprises a control element, with whose help the pivot lever (20) and thus the positioning roller (13) may be moved.

15. A conveyor device according to claim 14, wherein the pivot lever (20) and the control lever (25) are connected to one another in a rigid manner.

16. A conveyor device according to claim 14, wherein the pivot lever (20) and the control lever (25) are pivotable about pivot axes distanced to one another parallel to the conveyor path, and are articulately connected to one another by way of a sliding joint (55).

17. A conveyor device according to claim 7, wherein the tension roller (12) is arranged at the second fastening location (11) and that the positioning roller (13) is fastened on the support belt (5) and is arranged in a fixed rotation position on a pivot lever (20).

18. A conveyor device according to claim 17, wherein the pivot lever (20) comprises two twin levers (20.1 and 20.2) which are arranged in each case laterally of the support belt (5).

19. A conveyor device according to claim 17, wherein the pivot lever comprises a setting limb (60), on which the positioning roller (13) is arranged, and a control limb (61) with a control element (26), wherein the setting limb (60) and the control limb (61) are pivotably arranged about the same axis (62) and are connected to one another via a biased spring (23).

20. A conveyor device according to claim 2, wherein the conveyor compartments (2) are fastened in an equally directed and successive manner on a revolvingly drivable conveyer member (6).

21. A conveyor device according to claim 20, wherein a roller body (8) is assigned to each conveyor compartment (2) and is fastened on the conveyor member (6) and carries runner rollers (9) running along rails (7).

22. A conveyor device according to claim 21, wherein the first fastening location (10) and the setting element (3) of the conveyor compartment (2) are arranged on the roller body (8) assigned to the conveyor compartment (2), and that the second fastening location (11) is arranged on the roller body (8) assigned to an adjacent conveyor compartment (2").

23. A conveyor device according to claim 21, wherein an additional roller body (8.1) is assigned to each conveyor compartment (2) and is arranged between the two fastening locations (10 and 11).

24. A conveyor device according to claim 21, wherein the conveyor member (6) comprises two parallel toothed belts (6.1 and 6.2).

25. A conveyor device according to claim 21, wherein the roller bodies (8) comprise a U-shaped profile (33), wherein a middle part of the profile (33) is connected to the conveyor member (6) and outer parts of the profile (33) carry the runner rollers (9).

26. A conveyor device according to claim 21, wherein the roller bodies (8) comprise two side parts (55.1 and 55.2) and a transverse part (57), wherein the transverse part (57) is connected to the conveyor member (6) and the side parts carry the runner rollers (9).

27. A conveyor device according to claim 26, wherein the transverse part (57) forms a part of the support surface (S) and forms a wall (65) of the conveyor compartment (2).

28. A conveyor device according to claim 1, wherein the support belt (5) consists of a textile fabric or of a plastic foil.

29. A conveyor device according to claim 1, wherein a stiffening means is arranged on the surface of the support belt (5), which forms the support surface (S) at least over a part of the belt length.

30. The use of a conveyor device according to claim 1, for collating flat objects (G), in particular printed products, wherein a stack of printed products is collated in each conveyor compartment (2).

31. The use according to claim 30, wherein the stack at a transfer location (U) at which the conveyor path (1) of the conveyor device is deflected, is transferred to a further conveyor device (40).

32. The use according to claim 31, wherein the transfer location (U) is arranged in a conveyor path region with reverse conveying.

33. The use according to claim 31, wherein the stacks are selectively transferred at the transfer location (U).

* * * * *